US011845578B2

(12) United States Patent
Gibson et al.

(10) Patent No.: US 11,845,578 B2
(45) Date of Patent: Dec. 19, 2023

(54) POUCHED PRODUCT FOR ORAL USE, SEALING METHOD, SEALING DEVICE, METHOD AND APPARATUS FOR MANUFACTURING A POUCHED PRODUCT FOR ORAL USE

(71) Applicant: Swedish Match North Europe AB, Stockholm (SE)

(72) Inventors: Lotte Gibson, Gothenburg (SE); Jonas Lindberg, Trollhättan (SE)

(73) Assignee: SWEDISH MATCH NORTH EUROPE AB, Stockholm (SE)

( * ) Notice: Subject to any disclaimer, the term of this patent is extended or adjusted under 35 U.S.C. 154(b) by 0 days.

(21) Appl. No.: 18/249,378

(22) PCT Filed: Oct. 20, 2021

(86) PCT No.: PCT/EP2021/079046
§ 371 (c)(1),
(2) Date: Apr. 17, 2023

(87) PCT Pub. No.: WO2022/090017
PCT Pub. Date: May 5, 2022

(65) Prior Publication Data

US 2023/0286688 A1 Sep. 14, 2023

(30) Foreign Application Priority Data

Oct. 29, 2020 (EP) ..... 20204536

(51) Int. Cl.
*B65B 9/20* (2012.01)
*B65B 51/07* (2006.01)
(Continued)

(52) U.S. Cl.
CPC ..... *B65B 51/07* (2013.01); *A24B 13/00* (2013.01); *B65B 9/2056* (2013.01); *B65B 29/00* (2013.01);
(Continued)

(58) Field of Classification Search
None
See application file for complete search history.

(56) References Cited

U.S. PATENT DOCUMENTS 9,066,540 B2 * 6/2015 Atchley ..... D04H 1/43838
2006/0225258 A1 10/2006 Barker et al.
(Continued)

FOREIGN PATENT DOCUMENTS

EP 0232928 A1 8/1987
EP 3330191 A1 6/2018

OTHER PUBLICATIONS

International Search Report and Written Opinion were dated Feb. 3, 2022 by the International Searching Authority for International Application No. PCT/EP2021/079046 filed on Oct. 20, 2021 (Applicant Swedish Match North Europe AB) (12 pages).

*Primary Examiner* — Dennis R Cordray
(74) *Attorney, Agent, or Firm* — Ballard Spahr LLP

(57) ABSTRACT

Described is a pouched product for oral use with a filling material and a saliva-permeable pouch. The pouch is made of a saliva-permeable packaging material that includes fibres and enclosing the filling material. The pouch has a first seal joining at least two plies of the packaging material. The at least two plies are interconnected in the first seal by inter-ply fibres, the inter-ply fibres being fibres which are present in at least two plies of the at least two plies.

17 Claims, 3 Drawing Sheets

(51) Int. Cl.

| | |
|---|---|
| ***A24F 23/02*** | (2006.01) |
| ***D04H 1/46*** | (2012.01) |
| ***A24B 13/00*** | (2006.01) |
| ***D04H 1/498*** | (2012.01) |
| ***B65B 29/00*** | (2006.01) |

(52) U.S. Cl.
CPC ..... *D04H 1/498* (2013.01); *D10B 2401/12* (2013.01); *D10B 2505/10* (2013.01)

(56) References Cited

U.S. PATENT DOCUMENTS

| | | | |
|---|---|---|---|
| 2012/0031414 | A1 | 2/2012 | Atchley et al. |
| 2014/0261473 | A1 | 9/2014 | Carrol et al. |

* cited by examiner

POUCHED PRODUCT FOR ORAL USE, SEALING METHOD, SEALING DEVICE, METHOD AND APPARATUS FOR MANUFACTURING A POUCHED PRODUCT FOR ORAL USE

CROSS-REFERENCE TO RELATED APPLICATIONS

This application is a U.S. National Phase Application of International Application No. PCT/EP2021/079046, filed Oct. 20, 2021, which claims priority to European Application No. 20204536.5, filed Oct. 29, 2020, each of which are hereby incorporated by reference in their entirety.

TECHNICAL FIELD

The present invention relates to a pouched product for oral use. The present invention further relates to a sealing method and a sealing device. In addition, the present invention relates to a method and an apparatus for manufacturing a pouched product for oral use.

BACKGROUND

A pouched product for oral use may be produced by measuring a portion of a filling material, e.g. a smokeless tobacco composition, and enclosing the portion by a packaging material forming a saliva-permeable pouch containing the filling material.

U.S. Pat. No. 4,703,765 discloses a device for packaging precise amounts of finely divided tobacco products, such as snuff tobacco or the like, in a packaging material into which snuff portions are injected via a fill tube. A flat web of packaging material is formed into a tubular web around the fill tube. Downstream from the fill tube, welding means are positioned for transverse sealing of the packaging material, and also cutting means for severing the packaging material in the area of the transverse seal to form discrete or individual portion packages.

Pouched products for oral use may alternatively be produced by placing portions of a filling material, such as moist snuff, on a nonwoven web using a pouch packer machine in accordance with the device disclosed in U.S. Pat. No. 6,135,120. This device comprises feeding means for feeding the tobacco material into pockets formed in a rotary portioning wheel for portioning the material into portions, at least one compression means for compressing the tobacco material portions, a unit for advancing a packaging material, such as a nonwoven web, in synchrony with the portions, at least one discharge means for discharging the portions from the pockets to the packaging material, and a forming unit for forming individual portion-packages, i.e. pouched products for oral use, from the discharged portions and the packaging material. At the intended point of discharge of the portions to the packaging material, the packaging material has the form of a tape. The compression means are arranged to compress the portions in a direction which differs from the discharging and the feeding directions. The compression is preferably effected in a direction perpendicular to the discharging and the feeding directions. The compression may be effected in the axial direction of the portioning wheel whereas the feeding and discharging may be effected in the radial direction of the wheel.

The pouched products manufactured by the methods disclosed in U.S. Pat. Nos. 4,703,765 and 6,135,120 have in common that sealing is made by welding two overlapping plies of the packaging material being pressed together, also called heat-sealing. The bonding in such a welded seal is obtained by a heat-induced crosslinking reaction of the binder of the packaging material and/or by at least partial melting or softening of the packaging material in the seal. It thus follows that the packaging material should be suitable for welding, e.g. a nonwoven material with a thermoplastic bonding agent as mentioned in U.S. Pat. No. 6,135,120. As an alternative or a complement, fibres of the packaging material may be thermoplastic or may comprise a thermoplastic component, such that they may soften and/or melt at least partly in the seal.

It is also known to perform sealing of pouched products for oral use by means of ultrasonic welding, as e.g. disclosed in EP 33833746 B1. Also in the ultrasonic seal, bonding is obtained by a heat-induced crosslinking reaction of the binder and/or at least partial melting or softening of the packaging material in the seal. Hence, the packaging material should be suitable for ultrasonic welding.

From the above, it may be concluded that the sealing method sets certain technical requirements for the packaging material in order to be able to form strong enough seals by means of the heat-induced crosslinking reaction of the binder and/or the at least partial melting and/or softening in the seals. Such technical requirements may, on the other side, make it difficult, or even unfeasible, to use an environmentally-friendly packaging material, such as a biodegradable packaging material, since it may not be suitable for welding or ultrasonic welding.

It is thus a desire to be able to provide a sealing method and a sealing device giving a larger freedom when selecting a packaging material, in particular the freedom to select an environmentally-friendly packaging material. It is further a desire to be able to provide a pouched product for oral use comprising such a packaging material and a method and an apparatus for manufacturing such a pouched product for oral use.

SUMMARY

The object of the present disclosure is to overcome or ameliorate at least one of the disadvantages of the prior art, or to provide a useful alternative.

The object above is achieved by the subject-matter of the independent claims. Embodiments are set forth in the appended dependent claims, in the following description and in the drawings.

The present disclosure relates to a pouched product for oral use according to claim 1. The pouched product comprises a filling material and a saliva-permeable pouch. The pouch is made of a saliva-permeable packaging material comprising fibres and enclosing the filling material. The pouch comprises a first seal joining at least two plies of the packaging material. The at least two plies are interconnected in the first seal by inter-ply fibres, each of the inter-ply fibres being present in at least two plies of the at least two plies.

The seal is arranged to retain the filling material in the pouch, such that the risk of leakage of the filling material out of the pouch is prevented or at least reduced.

The fibres of the saliva-permeable packaging material may be of any suitable length and coarseness. The fibres may be mono-component fibres, bicomponent fibres, multicomponent fibres or a mixture thereof. The fibres may be man-made or natural. The fibres may be cut staple fibres. The fibres may have a natural length similar to those of cut staple fibres, such as plant fibres. The fibres may also be continuous, e.g. in the form of filaments. Different kinds of fibres may be mixed with each other.

The two plies may be a result of folding or bending the packaging material. The packaging material is typically supplied as a single-ply web of packaging material. In that case, the web is typically folded or bent in its length direction, such that one portion of the original web overlies another portion of the original web, i.e. locally forming two overlapping plies of the web. This may e.g. be used to form a tubular web.

As an alternative, two individual webs of packaging material may be provided, which are positioned with one web on top of the other web.

When forming the seal, a plurality of plies, typically two plies of the packaging material, i.e. a first and a second ply, are joined to each other by the inter-ply fibres, which are fibres present in both plies. Each of the inter-ply fibres extends from one ply to the other ply and is entangled with fibres from the respective plies to be joined, thereby creating a mechanical bond between the fibres.

As an example, when forming a seal joining two plies of the packaging material, fibres from one of the plies, i.e. the first or the second ply, are pulled into the other ply, i.e. the second or the first ply, and entangling with the fibres of the other ply. Optionally, also fibres from the other ply are pulled into the first ply entangling with the fibres of the first ply. These pulled fibres form inter-ply fibres, i.e. fibres which each are present in both plies, i.e. in both the first and second ply.

As an alternative or a complement to forming inter-ply fibres of fibres of the packaging material, fibres comprised in the filling material may form inter-ply fibres in the seal, as is further described below. These two origins of inter-ply fibres may be combined, such that the fibres forming the inter-ply fibres in the seal may come both from the packaging material and the filling material.

By providing a plurality of inter-ply fibres, the two plies of the packaging material are joined to each other by means of the inter-ply fibres. Hence, a seal according to the invention may be obtained without any welding and/or application of an adhesive, even if welding and/or adhesive may be used in addition to the inter-ply fibre bonding to further strengthen the seal. However, it is sometimes preferred to provide a seal without any welding and/or application of an adhesive, i.e. the entire seal strength is provided by the inter-ply fibres.

The seal can be configured to be sufficiently strong by just utilizing the inter-ply fibres. The seal being sufficiently strong means, that the risk of leakage of the filling material out of the pouch is minimized or at least reduced. This relates both to transport and storage of the pouched product and during use in a buccal cavity of the user. The seal will remain strong over time, since it is a mechanical connection, which is not, or only minimally, influenced by components of the filling material, such as flavouring agents, some of which are known to negatively affect seal strength over time for prior art pouched products. Further, the seal is sufficiently strong also when the pouched product is wet, such as in the buccal cavity of the user. It has been found that a seal according to the invention may have at least the same seal strength as seals formed by prior art methods such as heat-sealing or ultrasonic welding.

The pouched product for oral use may be a pouched tobacco product for oral use, e.g. a snuff product or a snus product, a pouched nicotine containing product for oral use or a pouched nicotine-free product for oral use. Such pouched products are sometimes called snuff products or snus products.

The pouched product for oral use is typically a portion-packed product i.e. each pouch encloses an amount of filling material, which is intended to make up a portion of a suitable size. The pouched product is configured to fit comfortably and discreetly in a user's buccal cavity, e.g. between the upper and/or lower gum and the lip. It is not intended to be swallowed.

The pouched product for oral use described herein may be dry, semi-dry or moist. Generally, dry pouched products have a moisture content of less than 10 wt % and moist pouched products have a moisture content of above 40 wt %. Semi-dry pouched products have a moisture content between 10 wt % and 40 wt %.

The pouched product may be flavoured by mixing the flavour in the filling material during manufacturing. Additionally or alternatively, the flavour may be added to the pouched product after it has been manufactured or may be added in a user container for containing a plurality of portion packed products.

By the term "tobacco" as used herein is meant any part, e.g., leaves, stems, and stalks, of any member of the genus *Nicotiana*. The tobacco may be whole, shredded, threshed, cut, ground, cured, aged, fermented, or treated otherwise, e.g. granulated or encapsulated.

The term "tobacco material" is used herein for tobacco leaves or parts of leaves, such as lamina and stem. The leaves and parts of leaves may be finely divided (disintegrated), such as ground, cut, shredded or threshed, and the parts of leaves may be blended in defined proportions in the tobacco material.

The filling material may comprise a finely divided tobacco material such as a ground tobacco material or cut tobacco. In addition to the tobacco material, the filling material may further comprise at least one of the following: water, salt (e.g. sodium chloride, potassium chloride, magnesium chloride, and any combinations thereof), pH adjuster, flavouring agent, cooling agent, heating agent, sweetening agent, colorant, humectant (e.g. propylene glycol or glycerol), antioxidant, preservative (e.g. potassium sorbate), binder, disintegration aid. In an example, the filling material comprises or consists of finely divided tobacco material, salt such as sodium chloride, and a pH adjuster.

For pouched products with no or low tobacco content, to which nicotine is added, the nicotine of the filling material may be synthetic nicotine and/or nicotine extract from tobacco plants. Further, the nicotine may be present in the form of nicotine base and/or a nicotine salt. The nicotine salt may be free, i.e. it is mixed with the other components of the product without combining chemically with said components. Additionally or alternatively, the nicotine salt may combine chemically with one or more components of the filling material. For instance, the nicotine salt may combine with alginate particles or cellulose.

As used herein, the term "moisture content" refers to the total amount of oven volatile ingredients, such as water and other oven volatiles (e.g. propylene glycol) in the preparation, composition or product referred to. The moisture content may be given herein as percent by weight (wt %) of the total weight of the preparation, composition or product referred to. If not stated otherwise, moisture content is herein given in relation to the weight of the filling material.

The moisture content as referred to herein may be determined by using a method based on literature references Federal Register/vol. 74, no. 4/712-719/Wednesday, Jan. 7, 2009/Notices "Total moisture determination" and AOAC (Association of Official Analytical Chemics), Official Methods of Analysis 966.02: "Moisture in Tobacco" (1990), Fifth Edition, K. Helrich (ed). In this method, the moisture content is determined gravimetrically by taking 2.5±0.25 g sample and weighing the sample at ambient conditions, herein defined as being at a temperature of 22° C. and a relative humidity of 60%, before evaporation of moisture and after completion of dehydration. Mettler Toledo's Moisture Analyzer HB43, a balance with halogen heating technology, is used (instead of an oven and a balance as in the mentioned literature references) in the values described herein.

The sample is heated to 105° C. (instead of 99.5±0.5° C. as in the mentioned literature references). The measurement is stopped when the weight change is less than 1 mg during a 90 seconds time frame. The moisture content as weight percent of the sample is then calculated automatically by the Moisture Analyzer HB43.

Pouched products for oral use may or may not be post-moisturized after pouch formation. Pouched products which are not post-moisturized are herein referred to as non-post-moisturized. Post-moisturized pouched products may be produced by spraying water on the pouched product before packaging the pouched products in user containers. Post-moisturized pouches are sometimes referred to as "original" products. Non-post-moisturized pouched products are sometimes referred to as "white" products and are by some consumers considered to have a more appealing visual appearance. The moisture content of the final pouched product comprising a moist or semi-dry snuff or snus product is normally within the range of from 25 to 55 wt % based on the weight of the pouched product.

Pouched products for oral use are normally sized and configured to fit comfortably and discreetly in a user's mouth between the upper or lower gum and the lip. In general, pouched products for oral use have a generally rectangular shape. Some typical shapes (length×width) of commercially available pouched products for oral use are, for instance, 35 mm×20 mm, 34/35 mm×14 mm, 33/34 mm×18 mm, 27/28 mm×14 mm, 34 mm×10 mm and 38×14 mm. Typical pouched products for oral use may have a maximum length within the range of from 25 to 40 mm along the longitudinal direction of the product and a maximum width within the range of from 5 to 20 mm along the transverse direction of the product. The thickness ("height") of the pouched product is normally within the range of from 2 to 8 mm. The total weight of commercially available pouched products for oral use are typically within the range from about 0.2 to about 3.5 g, such as from about 0.5 to 1.7 g, per pouched product, the weights being defined at 21° C. and 50% RH.

A user container typically contains in the range of 10-30 pouched products, such as in the range of 20-25 pouched products. The pouched products may be placed randomly in the user container or in a pattern, for instance as described in WO 2012/069505 A1. The user container as disclosed herein is consumer package having a shape and a size adapted for conveniently carrying the consumer package in a pocket or in a handbag and may be used for packaging any known type of pouched product for oral use.

The term "tubular" as used herein refers to any cross-sectional shape; specifically, it is not restricted to a circular tubular web. The piece of tubular web may e.g. have a square, polygonal, elliptical or oval cross-sectional shape. However, the piece of tubular web has a closed circumference, such that the piece of tubular web is able to retain the filling material inside the piece of tubular web.

The fibres of the packaging material may constitute at least 60%, preferably at least 75%, more preferably at least 90%, most preferably 98% of a weight of the packaging material, such as all, or substantially all, of the packaging material, the weights being defined at 21° C. and 50% RH.

It is known from prior art to have a thermoplastic component, such as thermoplastic fibres, in a packaging material for pouch packing of products for oral use, which component will melt or soften if heat-sealing. Other prior art sealing methods utilize that a bonder of the packaging material, e.g. an acrylic bonder, crosslinks due to the heat used in the welding procedure. However, due to the inter-ply fibres present in the seal according to the present disclosure, there is no need for using thermoplastic fibres and/or bonders in the packaging material. Hence, the inter-ply fibre bonding as disclosed herein makes it possible to form a sealable packaging material from a broader range of fibre types. However, it is to be understood that it is feasible that the packaging material of the pouched product disclosed herein may include such thermoplastic fibres and/or bonder.

Hence, according to the invention, it is possible to use a packaging material for the pouched product without any thermoplastic component and also without a binder. On the other hand, it is also possible to use prior art packaging material comprising a thermoplastic component and/or a bonder.

The packaging material may comprise or be constituted by a nonwoven material. The nonwoven material normally used for pouched smokeless tobacco products may be similar to the packaging material used in tea bags. Nonwovens are fabrics which are neither woven nor knitted, i.e. which are not produced by traditional methods for forming textile webs. Methods for the manufacturing of nonwoven materials are commonly known in the art. The nonwoven materials may e.g. be spunbond, spunlaced, meltblown, bonded carded webs, etc., as known in the art.

At least 70%, preferably at least 80%, more preferably at least 90%, most preferably all or substantially all of the fibres of the packaging material, may be biodegradable fibres, the percent numbers being given as weight percentage defined at 21° C. and 50% RH. Thereby the pouched product may be made biodegradable. The packaging material may be compostable. Compostability is described in the standard EN 13432, which comprises sections about biodegradability, see ISO 14855, and quantitative disintegration, see ISO 16929.

The biodegradable fibres may for example be fibres of one or more of the following kinds: cellulose-based fibres, plant-based fibres, PLA, PHA and PBS. Examples of cellulose-based fibres are viscose or lyocell. For these fibres, the cellulose may origin from a tree or bush or from re-cycled cellulosic pulp. Examples of plant-based fibres are cotton, bamboo or tobacco. PLA stands for polylactic acid, PHA stands for polyhydroxyalkanoates and PBS stands for polybutylene succinate.

The pouch typically comprises a first side edge. The first seal may then be located at or adjacent to the first side edge of the pouch, thereby sealing the first side edge. Being located "at the edge" means that seal extends all the way to a common edge of the overlying plies of the packaging material without leaving any non-sealed parts of the packaging material between the edge and the seal. Being located "adjacent to the edge" means that there may be an interspace between the edge and the seal, which interspace may have a narrowest width in the range of 0-5 mm, or 0-3 mm. This interspace may e.g. correspond to the width needed for a cutting blade, which is used to separate pouched products from each other.

The pouch may in addition comprise a second side edge being opposite to the first side edge, the pouch comprising a second seal located at or adjacent to the second side edge of the pouch, wherein the at least two plies are interconnected in the second seal by inter-ply fibres, the inter-ply fibres being fibres which each are present in at least two plies of the at least two plies, the second seal sealing the second side edge.

The pouch, typically has a square or rectangular shape when seen from above. In that case, two opposing sides of the pouch may be sealed by a respective transverse edge seal, corresponding to the above-mentioned first and second seals. The term transverse relates to that the seal is formed in a cross-machine direction of the apparatus for manufacturing the pouched product. When the pouch is filled with contents in the form of filling material to form a pouched product, the square or rectangular shape of the pouch becomes somewhat modified with a thickened and narrowed central portion formed between the ends of the pouched product. When seen in three dimensions, the pouched product typically has a pillow-like shape.

The pouch may also have other shapes when seen from above, e.g. circular, semi-circular or a crescent. In that case, a seal according to the invention may be used to seal at least a portion of the edge of the pouch.

The pouch may comprise a third seal extending from the first seal to the second seal. Preferably the at least two plies are interconnected in the third seal by inter-ply fibres, the inter-ply fibres being fibres which each are present in at least two plies of the at least two plies. The third seal may form a longitudinal seal of the pouch, with longitudinal relating to that the longitudinal seal is formed in a machine direction of the apparatus for manufacturing the pouched product, also called a direction of travel. If a single third seal is provided, it is often positioned at or close to the longitudinal centre-line of the pouched product. If two third seals are provided, they are typically located at or adjacent to a respective longitudinal side edge of the pouched product.

Typically, the longitudinal seal/s is/are formed before the transverse edge seals. Hence, the longitudinal seal/s is/are comprised in the transverse edge seals. In the pouched product, this is seen by the third seal/s being comprised in the first and second seal. In that case, there may locally be four plies of packaging material overlying each other.

At least one of the seals of the pouched product is made with the sealing method as described herein. In a preferred embodiment, all seals or at least the first and the second seals are made with the sealing method as described herein. In the latter case, the third seal may be made by a prior art method, such as heat-sealing or ultrasonic welding.

The filling material of the pouched product may comprise fibres, which are entangled with the fibres of the packaging material in the first seal. The fibres of the filling material may also be entangled with the fibres of the packaging material in the second seal in a similar way.

If entangling with fibres of only one of the plies of the packaging material, the fibres of the filling material may help to anchor the filling material to the packaging material, but do not form inter-ply fibres.

As an alternative or a complement, the fibres of the filling material may be entangled with fibres of both the first and second plies, i.e. the fibres of the filling material may form inter-ply fibres contributing to the seal. This may be e.g. obtained by needle-punching from both outer surfaces of the plies, either simultaneously or sequentially. Such fibres of the filling material may thus be used both as inter-ply fibres in the seal and for anchoring the filling material to the packaging material.

The fibres comprised in the filling material may be of any suitable length and coarseness. The fibres may be mono-component fibres, bicomponent fibres, multicomponent fibres or a mixture thereof. The fibres may be man-made or natural. The fibres may be cellulose-based fibres, such as viscose or lyocell, or plant-based fibres, such as cotton, bamboo, cacao, maize or tobacco. The fibres may be cut staple fibres. The fibres may have a natural length similar to those of cut staple fibres, such as plant fibres. The fibres may also be continuous, e.g. in the form of filaments. Different kinds of fibres may be mixed with each other in the filling material.

The present disclosure also relates to a sealing method for sealing a saliva-permeable packaging material in order to form a pouched product for oral use, the packaging material comprising fibres. The method comprises:

forming a seal by joining at least two plies of the packaging material by forming inter-ply fibres, which are present in at least two plies of the at least two plies.

The fibres forming inter-ply fibres may origin from the packaging material and/or the filling material. Typically the inter-ply fibres are formed by entangling at least a portion of the fibres located in the seal with other fibres in order to form the inter-ply fibres. The forming of inter-ply fibres may be performed by means of needle-punching, hydro-entangling or air-entangling. It has been found convenient, and is typically preferred, to use needle-punching. Thereby the needles may be provided with hooks for catching and moving fibres. As a alternative or a complement, the needle may be a fork needle, i.e. a needle having a top end split in a V-shape or a U-shape, such that it is adapted to catch a fibre and move it.

The seal may be formed at or adjacent to a side edge of the packaging material in order to seal a side edge of the pouch. Such a seal may be either a transverse or a longitudinal seal, with the terms transverse and longitudinal relating to the apparatus for manufacturing the pouched product.

The seal of the sealing method may be formed to retain the packaging material in a tubular shape in order to form the pouch. Such a seal is typically a longitudinal seal.

The sealing method may further comprise:

flattening protruding fibres and/or fibre ends of the packaging material along a surface of the packaging material, and/or bringing back protruding fibres and/or fibre ends of the packaging material into the packaging material.

Thereby a flatter and smoother outer surface of the pouched product may be obtained, i.e. the outer surface of the pouched products has fewer, or preferably no protruding fibres or fibre ends, as compared to only performing the step of forming inter-ply fibres. The flatter surface may be perceived as beneficial by the user of the pouched product, since it looks neater and/or since it feels more comfortable in the buccal cavity.

This may for example be performed by running the seal through a nip between two rollers applying pressure and thereby flattening fibres or bringing them back into the plies. One or both of the rollers may be run with a different speed than the packaging material has through the nip. It would also be feasible to run the packaging material over a still-standing surface. A further alternative or a complement would be to rub one or both outer surfaces of the packaging material.

The present disclosure further relates to a method for manufacturing a pouched product for oral use, the method comprising:

a) providing a web of saliva-permeable packaging material, b) forming a tubular web of the web of saliva-permeable packaging material by making a longitudinal seal, c) providing the piece of tubular web with a first transverse seal, d) supplying a filling material to be enclosed by the tubular web, e) providing the piece of tubular web with a second transverse seal thereby forming a pouched product, f) separating the pouched product from a subsequent pouched product in or at the second transverse seal, wherein at least one of the longitudinal seal, the first transverse seal or the second transverse seal is provided by means of the sealing method described herein.

The filling material is typically supplied portion-wise, with a portion corresponding to the amount of filling material in the pouched product.

Preferably, both the first transverse seal and the second transverse seal are provided by the sealing method described herein. Typically, the second transverse seal of a certain pouched product is made at the same time, and in the same operation step, as the first transverse seal of the subsequent pouched, i.e. the transverse is made as a combined transverse seal with step e) for one product being performed at the same time as step c) for the subsequent pouched product. The combined transverse seal then forms a common seal having a width being the sum of the width of the second transverse seal of the pouched product+the width of the first transverse seal of the subsequent pouched product. Step f) is thereafter performed by cutting in this combined transverse seal, typically at or close to its centre as seen in the machine direction, also called the direction of travel.

The above order of the method steps b)-d) may be applicable for a manufacturing method corresponding to the method described in the above-mentioned U.S. Pat. No. 4,703,765. If instead performing a method corresponding to the method described in the above-mentioned U.S. Pat. No. 6,135,120, step d) may be performed before steps b) and c).

Steps a) and b) may be performed as separate steps before continuing with the rest of the method, e.g. such that a tubular web is formed and stored in an intermediate storage.

Steps c) and e) may be divided into substeps, e.g. by needle-punching from the respective outer surface in a number of substeps.

It is also feasible to alternate steps of forming inter-ply fibres, e.g. by entangling, with steps of flattening and/or bringing back protruding fibres or fibre ends in order to form the seals of steps c) and/or e).

The present disclosure further relates to a sealing device for sealing a saliva-permeable packaging material in order to form a pouched product for oral use, the packaging material comprising fibres. The sealing device comprises an entangling unit, such as a unit for needle-punching, hydro-entangling or air-entangling, configured to form a seal by joining at least two plies of the packaging material by forming inter-ply fibres, which are present in at least two plies of the at least two plies, e.g. by entangling at least a portion of the fibres located in the seal with each other. The sealing device is configured to perform the sealing method as described herein.

The present disclosure furthermore relates to an apparatus for manufacturing a pouched product for oral use, the apparatus comprising a first feeding unit for supplying an advancing web of packaging material, a second feeding unit for supplying a filling material to the advancing web, a forming unit for arranging the web of packaging material to enclose the filling material, the forming unit being located before or after the second feeding unit, at least one sealing device as described herein arranged for sealing the packaging material, thereby making at least one seal of the pouched product for oral use.

The apparatus is configured to perform the method for manufacturing a pouched product for oral use as described herein.

The apparatus may comprise:

a first sealing device as described herein for providing the pouched product with a longitudinal seal, and/or a second sealing device as described herein for providing the pouched product with a transverse seal.

It has been found convenient, and is typically preferred, to use a unit for needle-punching for forming inter-ply fibres. In that case, the welding unit of a prior art apparatus for manufacturing a pouched product for oral use may be replaced by a unit for needle-punching without any need for other rebuild of the apparatus, or at least without any need for a major rebuild of the apparatus.

BRIEF DESCRIPTION OF THE DRAWINGS

The present invention will hereinafter be further explained by means of non-limiting examples with reference to the appended drawings wherein.

It should be noted that the appended drawings are not necessarily drawn to scale and that the dimensions of some features of the present invention may have been exaggerated for the sake of clarity.

DETAILED DESCRIPTION

The invention will in the following be exemplified by embodiments. It should however be realized that the embodiments are included in order to explain principles of the invention and not to limit the scope of the invention, defined by the appended claims. Details from two or more of the embodiments may be combined with each other.

Figure 1A:
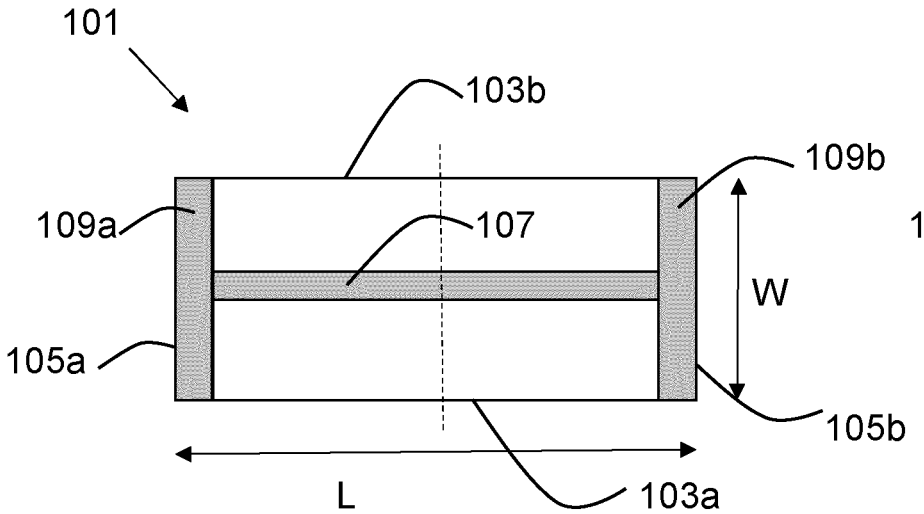
FIG. 1*a-b* illustrate a pouched product for oral use according to the invention.
Figure 1B:
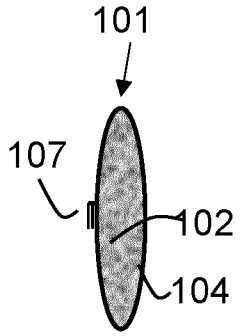

FIGS. 1*a* and 1*b* schematically illustrate a pouched product for oral use 101 according to the invention. The pouched product 101 has a rectangular shape with a maximum length L extending in a length direction and a maximum width W extending in a width direction, whereby the maximum length L typically is greater than the maximum width W. The pouched product 101 comprises a filling material 102 and a saliva-permeable pouch 104 enclosing the filling material 102. The pouched product 101 comprises two long side edges 103*a*, 103*b* and two short side edges 105*a*, 105*b*. The pouched product 101 also has an extension in a height direction, being perpendicular to the length direction and to the width direction, as seen in FIG. 1*b*. When seen in three dimensions, not illustrated, the pouched product 101 typically has a pillow-like shape.

The pouched product 101 comprises at least one seal 107 extending in the length direction. Typically, and as illustrated in FIG. 1*a*, there is a single seal 107 extending centrally between the long side edges 103*a*, 103*b* in the length direction. This seal is often called a longitudinal seal, since, when manufacturing the pouched product 101, this seal is made along the direction of travel of the web forming the pouch. The longitudinal seal is often positioned spaced apart from the long side edges 103*a*, 103*b*. Thereby it is often preferred to position it at or close to the longitudinal centre-line, as is illustrated in FIG. 1*a*. However, other locations of the longitudinal seal may be used, such as along one of the long side edges 103*a*, 103*b*. The longitudinal seal 107 may be made by the sealing method described herein or by any method known to the skilled person, e.g. heat-sealing or ultrasonic welding. Commonly, the longitudinal seal 107 is formed as a fin seal, which is folded down upon the packaging material, such that the pouch locally comprises three plies of packaging material on top of the filling material. See the schematic cross-sectional view in FIG. 1*b*.

Further, the pouched product 101 comprises two seals 109*a*, 109*b* extending in the width direction. The two seals 109*a*, 109*b* seal the two short side edges 105*a*, 105*b* and thus form edge seals. These seals 109*a*, 109*b* are often called transverse edge seals, since, when manufacturing the pouched product 101, these edge seals are made transverse to the direction of travel of the web forming the pouch 104. In the transverse edge seals, the packaging material forming the saliva-permeable pouch is double, i.e. it contains two plies of the packaging material. The transverse edge seals 109*a*, 109*b* may be made by the sealing method described herein or by any method known to the skilled person, e.g. heat-sealing and/or ultrasonic welding.

Since the transverse edge seals 109*a*, 109*b* typically are made after the longitudinal seal 107, i.e. downstream in the manufacturing apparatus, the longitudinal seal 107 is included in the transverse edge seals 109*a*, 109*b*, i.e. the longitudinal seal 107 forms part of the transverse edge seals 109*a*, 109*b*. Hence, at those locations, the packaging material forming the saliva-permeable pouch 104 consists of four plies on top of each other.

In the pouched product according to the invention, at least one of the above-mentioned seals, i.e. at least one longitudinal seal or at least one transverse edge seal, is made with the sealing method as described herein. Purely as an example, both transverse edge seals may be made with the sealing method as described herein. As an alternative or a complement, the at least one longitudinal seal may be made with the sealing method as described herein. In a preferred embodiment, all seals or at least the transverse edge seals are made with the sealing method as described herein.

Figure 2:
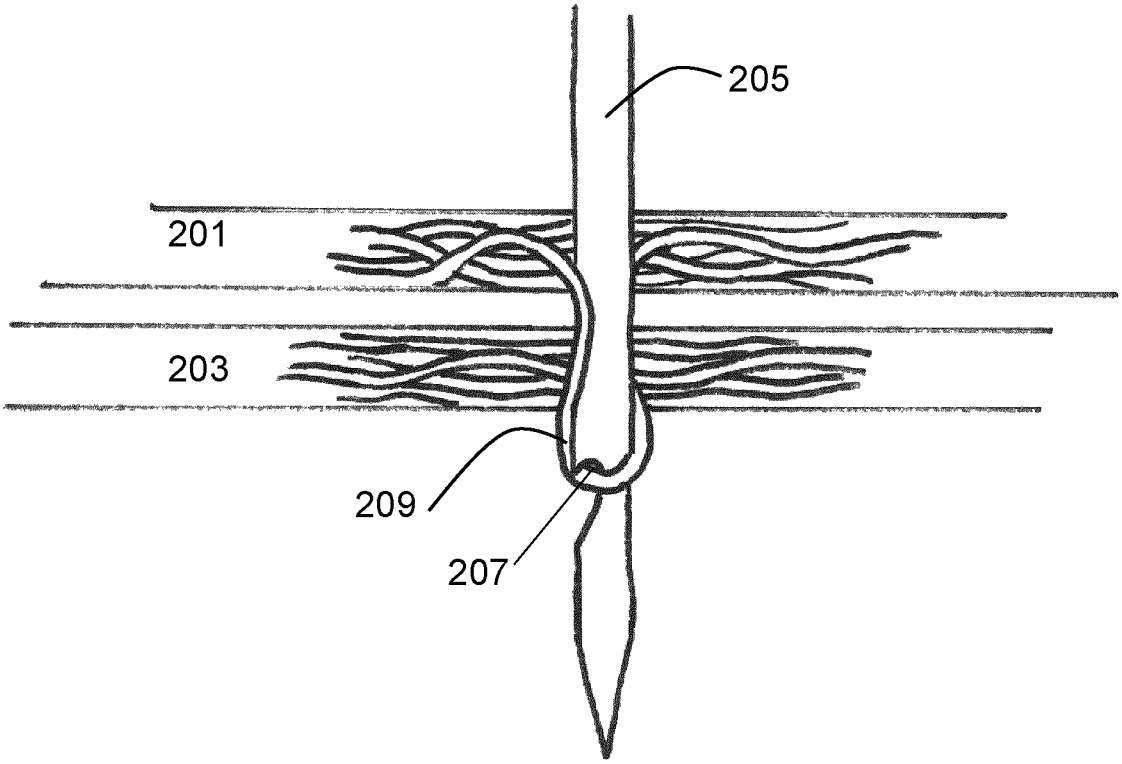
FIG. 2 illustrates a needling operation being made.

When forming a seal according to the invention as described herein, a plurality of plies, typically two plies of the packaging material, i.e. a first ply 201 and a second ply 203, are joined to each other by entangling fibres from the different plies 201, 203, as is illustrated in FIG. 2. Hence, for a seal joining two plies 201, 203 of the packaging material, parts of fibres from the first ply 201 are pulled into the second ply 203 and are entangled with the fibres of the second ply 20, thereby forming inter-ply fibres as disclosed herein. Movement of parts of fibres from the first ply 201 into the second ply 203 may be performed by needle-punching, as is illustrated in FIG. 2, wherein a needle 205 provided with a hook 207 grips a fibre 209 of the first ply 201 and pulls the fibre 209 through the second ply 203. Thereby an inter-ply fibre 209 is formed, i.e. a fibre being present in both the first ply 201 and the second ply 203. Typically a plurality of needles 205 are used for entangling a plurality of fibres 209 at the same time. Each needle may comprise one or more hooks.

Accordingly, in an optional process which is not illustrated in FIG. 2, also fibres from the second ply 203 can be pulled into the first ply 201 entangling with the fibres of the first ply 201. This may be obtained by needle-punching in the other direction, i.e. starting from the outer surface of the second ply 203.

By creating a plurality of inter-ply fibres 209 in the seal, e.g. by means of a plurality of needles 205 operating next to each other over the surface of the seal, the two plies 201, 203 are locally joined to each other and the seal is formed. As described herein, a sufficiently strong seal can be obtained without any welding and/or application of an adhesive, even if welding and/or adhesive may be used to further strengthen the seal.

Figure 3:
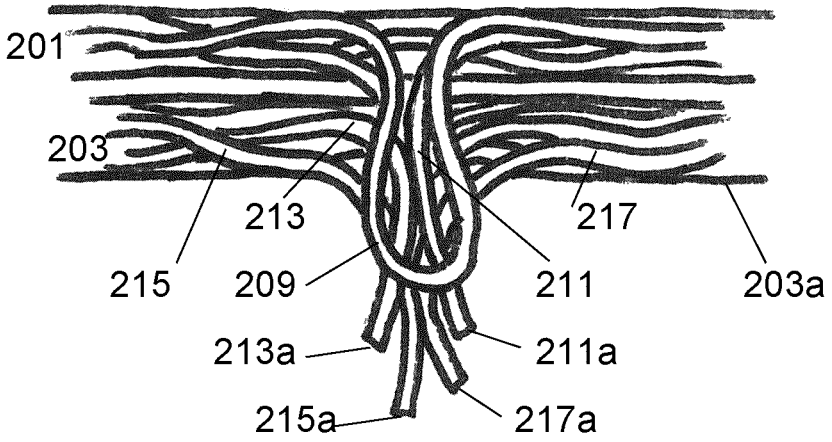
FIG. 3 illustrates a detailed view of a seal of the pouched product of FIG. 1*a*.

FIG. 3 illustrates a situation after the needle 205 has moved forwards into the packaging material and then backwards out of the packaging material. In this example, the needle 205 has pulled the fibre 209, such that it goes back and forth in a loop between the two plies 201, 203, cf. FIG. 2 showing the needle 205 when it has moved forwards into the packaging material. Another fibre 211 has been pulled from the first ply 201, through the second ply 203 such that its fibre end 211*a* protrudes from an outer surface 203*a* of the second ply 203. Also this fibre 211 forms an inter-ply fibre, since it is present in both plies 201, 203 and contribute to forming the seal.

In the FIG. 3 example further fibres 213, 215, 217 have been pulled out from the second ply 203 such that their respective fibre ends 213*a*, 215*a*, 217*a* protrude from the outer surface 203*a* of the second ply 203. These fibre are not inter-ply fibres, since they originate from the second ply 203 and are not present with any part in the first ply 201. Nevertheless, they contribute to the seal by entangling with the fibres 209, 211 from the first ply 201.

If desirable, the protruding fibres 209 and/or the protruding fibre ends 211*a*, 213*a*, 215*a*, 217*a* can be flattened along the outer surface 203*a* of the second ply 203 and/or brought back into the packaging material to create a neater and smoother seal.

Figure 4:
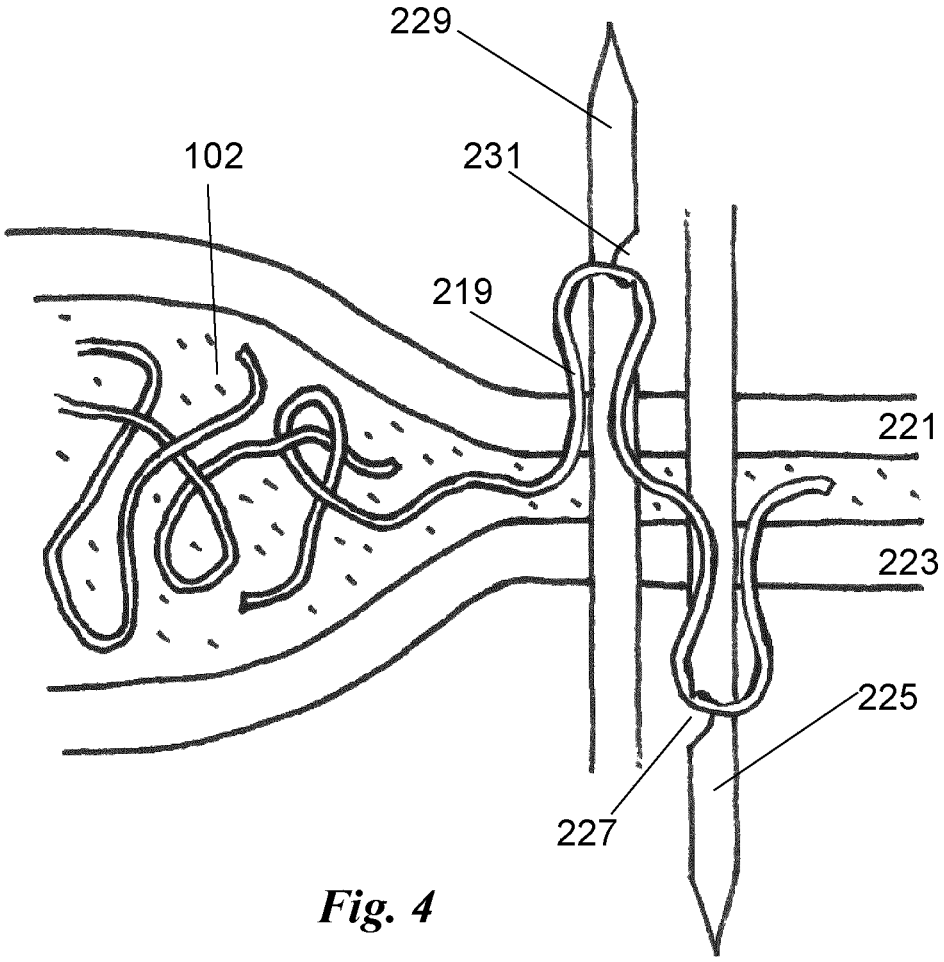
FIG. 4 illustrates a detailed view of a seal of another pouched product according to the invention.

In another embodiment, the filling material 102 of the pouched product comprises fibres 219 suitable for entangling, see FIG. 4. In that case, these fibres 219 of the filling material 102 can form inter-ply fibres in the seal. In the illustrated seal, the fibre 219 of the filling material entangles with fibres in both plies 221, 223 of the packaging material, the fibres of the plies 221, 223 not being illustrated individually. This effect may be obtained by needle-punching from both outer surfaces of the plies 221, 223, as is illustrated. In that case, the needles 225, 229 coming from the respective outer surface may be of the same kind having one or more hooks 227, 231 or the needles may be of different kinds. Even if needle-punching from only one of the outer surfaces, cf. FIG. 2, the needles used may be of different kinds.

As an alternative, not illustrated, it is also feasible that the fibre/s 219 of the filling material 102 is/are only entangled with one of the plies 221, 223 of the packaging material, thereby helping to anchor the filling material 102 to the packaging material but not forming inter-ply fibres.

As can be understood from the above, a sealing method for sealing a saliva-permeable packaging material in order to form a pouched product 101 for oral use as described herein comprises:

forming a seal 107, 109*a*, 109*b* by joining at least two plies 201, 203; 221, 223 of the packaging material by forming inter-ply fibres 209, 211; 219, which are present in at least two plies 201, 203; 221, 223 of the at least two plies.

Figure 5:
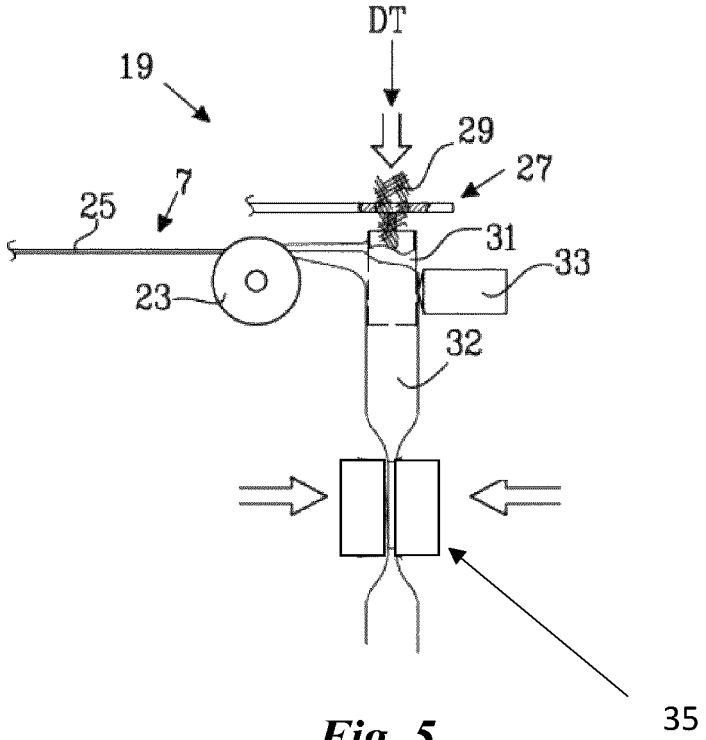
FIG. 5 illustrates an apparatus for manufacturing a pouched product for oral use.

FIG. 5 illustrates an apparatus 19 according to the invention for manufacturing a pouched product for oral use, e.g. the pouched product illustrated in FIG. 1*a-b*. The apparatus 19 comprises a first feeding unit 23 for supplying a planar web 25 of the packaging material 7, a second feeding unit 27 for supplying a filling material 29 to the advancing web 25, a forming unit 31 for arranging the web of packaging material to enclose the filling material 29 to form a tubular web 32 of the packaging material, a sealing device 33 for making a longitudinal seal and a sealing device 35 for making a transverse seal. The tubular web 32 moves in a direction of travel DT through the apparatus 19.

Figure 6:
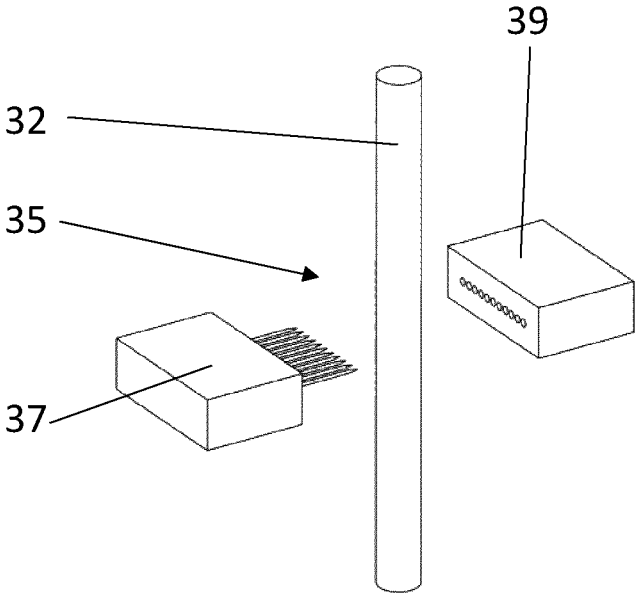
FIG. 6 illustrates a sealing device according to the invention.

At least one of the sealing devices 33, 35 is a sealing device according to the invention, which schematically is shown as the sealing device 35 for transverse sealing in FIG. 6. Such a sealing device is configured for sealing a saliva-permeable packaging material in order to form a pouched product for oral use, the packaging material comprising fibres. The sealing device according to the invention comprises an entangling unit, such as a unit for needle-punching, hydro-entangling or air-entangling, configured to form a mechanical seal as disclosed herein by joining at least two plies of the packaging material by forming inter-ply fibres, which each are present in at least two plies of the at least two plies, illustrated as a unit for needle-punching in FIG. 6.

The illustrated unit 35 for needle-punching comprises a first part 37 having a plurality of needles and a second part 39 adapted to receive the needles and forming an anvil for the needle-punching. The two parts 37, 39 are located at opposite sides of the tubular web 32. The needles may be arranged in a matrix, with the rows being seen in the direction of travel DT, also called the machine direction, and the columns being in the cross-machine direction. In the illustrated example, there is only a single row of needles and 11 columns of needles. However, there may also be a plurality of rows, such as e.g. 2-10 or 2-5. The number of columns may be in the range of 3-25, such as 5-20 or 10-15. The number of rows may be adapted to the desired width of the seal. Alternative, the unit 35 may operate a number of times in the same seal. The number of columns is preferably adapted to the width of the tubular web and the desired width of the seal. Please see the description above in conjunction with FIGS. 2-4 for details of the operation of the sealing device, e.g. the movement of the needles 205; 225, 229.

The second feeding unit 27 may be located downstream or upstream of the forming unit 31. If located downstream, the web 25 is first formed to a tubular web 32 and thereafter the filling material 29 is placed in the tubular web 32 as a portion, as for the apparatus 19 illustrated in FIG. 5, wherein a lower end of the second feeding unit 27 ends within the tubular web 32.

Alternatively, but not illustrated, the filling material may be placed on the planar web as a portion before the planar web is formed to a tubular web, such that the packaging material is arranged around the portion of the filling material to form the tubular web, thereby enclosing the portion of the filling material. A portion of filling material comprising fibres may be fixated on the planar web by entangling, such as by needle-punching as described herein.

Figure 7:
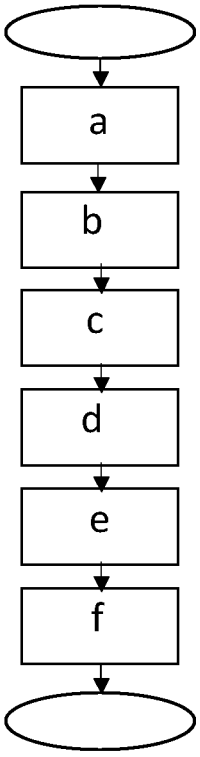
FIG. 7 illustrates a method for manufacturing a pouched product for oral use.

FIG. 7 shows a schematic outline of a method for manufacturing a pouched product oral use. The method comprises:

a) providing a web of saliva-permeable packaging material, b) forming a tubular web of the web of saliva-permeable packaging material by making a longitudinal seal, c) providing the piece of tubular web with a first transverse seal, d) supplying a filling material to be enclosed by the tubular web, e) providing the piece of tubular web with a second transverse seal thereby forming a pouched product, f) separating the pouched product from a subsequent pouched product in or at the second transverse seal, wherein at least one of the longitudinal seal, the first transverse seal or the second transverse seal is provided by means of the sealing method described herein.

Preferably both the first transverse seal and the second transverse seal are provided by the sealing method described herein. Typically, the second transverse seal of a first pouched product in a production line of pouched products is made at the same time and in the same operation step as the first transverse seal of the subsequent pouched product in the production line, i.e. the transverse seal is made as a combined transverse seal with step e) for the first pouched product being performed at the same time as step c) for the subsequent pouched product. The combined transverse seal then forms a common seal having a width being the sum of the width of the second transverse seal of the pouched product and the width of the first transverse seal of the subsequent pouched product. Step f) is thereafter performed by cutting in this combined transverse seal, typically at or close to its centre as seen in the machine direction to divide the formed combined transverse seal in two transverse seals of equal widths with one transverse seal belonging to a first pouched product forming a transverse edge seal and the other transverse seal belonging to a second pouched product forming a transverse edge seal.

The above order of the method steps b)-d) may be applicable for a manufacturing method corresponding to the method described in the above-mentioned U.S. Pat. No. 4,703,765. If instead performing a method corresponding to the method described in the above-mentioned U.S. Pat. No. 6,135,120, step d) may be performed before steps b) and c).

Further modifications of the invention within the scope of the appended claims are feasible. As such, the present invention should not be considered as limited by the embodiments and figures described herein. Rather, the full scope of the invention should be determined by the appended claims, with reference to the description and drawings.

The invention claimed is:

1. A pouched product for oral use, said pouched product for oral use comprising a filling material and a saliva-permeable pouch, said pouch being made of a saliva-permeable packaging material comprising fibres and enclosing said filling material, said pouch comprising a first seal joining at least two plies of said packaging material, characterized in that said at least two plies are interconnected in said first seal by inter-ply fibres, each of said inter-ply fibres being present in at least two plies of said at least two plies.

2. The pouched product for oral use according to claim 1, wherein said fibres of said packaging material constitute at least 60% of a weight of said packaging material.

3. The pouched product for oral use according to claim 1, wherein said packaging material comprises or is constituted by a nonwoven material.

4. The pouched product for oral use according to claim 1, wherein at least 70% of said fibres of said packaging material, are biodegradable fibres.

5. The pouched product for oral use according to claim 4, wherein said biodegradable fibres are fibres of one or more of the following kinds: cellulose-based fibres, plant-based fibres, PLA, PHA and PBS.

6. The pouched product for oral use according to claim 1, wherein said pouch comprises a first side edge and said first seal is located at or adjacent to said first side edge of said pouch thereby sealing said first side edge.

7. The pouched product for oral use according to claim 6, wherein said pouch comprises a second side edge being opposite to said first side edge, said pouch comprising a second seal located at or adjacent to said second side edge of said pouch, wherein said at least two plies are interconnected in said second seal by inter-ply fibres, said inter-ply fibres being fibres which each are present in at least two plies of said at least two plies, said second seal sealing said second side edge.

8. The pouched product for oral use according to claim 7, wherein said pouch comprises a third seal extending from said first seal to said second seal, said inter-ply fibres being fibres which each are present in at least two plies of said at least two plies.

9. The pouched product for oral use according to claim 1, wherein said filling material comprises fibres, which are entangled with said fibres of said packaging material.

10. A sealing method for sealing a saliva-permeable packaging material in order to form a pouched product for oral use, said packaging material comprising fibres, characterized in that said method comprises:

forming a seal by joining at least two plies of said packaging material by forming inter-ply fibres, which each are present in at least two plies of said at least two plies.

11. The sealing method according to claim 10, wherein said forming of inter-ply fibres is performed by means of needle-punching, hydro-entangling or air-entangling.

12. The sealing method according to claim 10, wherein said seal is formed at or adjacent to a side edge of said packaging material.

13. The sealing method according to claim 10, wherein said seal is formed to retain said packaging material in a tubular shape.

14. The sealing method according to claim 10 further comprising:

flattening protruding fibres and/or fibre ends of said packaging material along a surface of said packaging material, and/or bringing back protruding fibres or fibre ends of said packaging material into said packaging material.

15. A method for manufacturing a pouched product for oral use, said method comprising:

a) providing a web of saliva-permeable packaging material, b) forming a tubular web of said web of saliva-permeable packaging material by making a longitudinal seal, c) providing said piece of tubular web with a first transverse seal, d) supplying a filling material to be enclosed by said tubular web, e) providing said piece of tubular web with a second transverse seal thereby forming a pouched product, f) separating said pouched product from a subsequent pouched product in or at said second transverse seal, characterized in that at least one of said longitudinal seal, said first transverse seal or said second transverse seal is provided by means of the sealing method according to claim 10.

16. A sealing device for sealing a saliva-permeable packaging material in order to form a pouched product for oral use, said packaging material comprising fibres, characterized in that said sealing device comprises an entangling unit, configured to form a seal by joining at least two plies of said packaging material by forming inter-ply fibres, each of said inter-ply fibres being present in at least two plies of said at least two plies.

17. An apparatus for manufacturing a pouched product for oral use, said apparatus comprising a first feeding unit for supplying an advancing web of packaging material, a second feeding unit for supplying a filling material to said advancing web, a forming unit for arranging said web of packaging material to enclose said filling material, said forming unit being located before or after said second feeding unit, at least one sealing device according to claim 16 arranged for sealing said packaging material, thereby making at least one seal of said pouched product for oral use.

* * * * *